US009387503B2

(12) United States Patent
Santiago

(10) Patent No.: US 9,387,503 B2
(45) Date of Patent: Jul. 12, 2016

(54) SPRAY EDGER DEVICES SUITABLE FOR USE WITH MATERIAL APPLICATION APPARATUS

(76) Inventor: Fabian Santiago, Pomona, NY (US)

( * ) Notice: Subject to any disclaimer, the term of this patent is extended or adjusted under 35 U.S.C. 154(b) by 1060 days.

(21) Appl. No.: 12/991,801

(22) PCT Filed: May 11, 2009

(86) PCT No.: PCT/US2009/043497

§ 371 (c)(1),
(2), (4) Date: May 26, 2011

(87) PCT Pub. No.: WO2009/137841

PCT Pub. Date: Nov. 12, 2009

(65) Prior Publication Data

US 2011/0214607 A1 Sep. 8, 2011

Related U.S. Application Data

(60) Provisional application No. 61/051,995, filed on May 9, 2008.

(51) Int. Cl.
*B05B 15/04* (2006.01)

(52) U.S. Cl.
CPC ..... *B05B 15/0437* (2013.01); *B05B 15/0443* (2013.01)

(58) Field of Classification Search
CPC ..... B05B 15/0443; B05B 15/0437
See application file for complete search history.

(56) References Cited

U.S. PATENT DOCUMENTS

| | | | | | |
|---|---|---|---|---|---|
| 2,842,093 | A | * | 7/1958 | O'Neill | 118/301 |
| 3,069,713 | A | | 12/1962 | Obraske | |
| 3,090,984 | A | | 5/1963 | Dunnigan | |
| 4,085,703 | A | | 4/1978 | Glowacki | |
| 4,248,914 | A | | 2/1981 | McClane | |
| 4,315,600 | A | * | 2/1982 | Rhoades et al. | 239/74 |
| 4,559,245 | A | | 12/1985 | Stark | |
| 4,574,731 | A | | 3/1986 | Stevens et al. | |
| 4,697,544 | A | | 10/1987 | Stevens et al. | |
| 4,767,056 | A | * | 8/1988 | Demetrius et al. | 239/288 |
| 4,791,007 | A | | 12/1988 | Gleason et al. | |
| 4,850,868 | A | * | 7/1989 | Wright et al. | 433/116 |
| 4,962,722 | A | | 10/1990 | Thompson | |
| 5,103,762 | A | | 4/1992 | Long et al. | |
| 5,261,144 | A | | 11/1993 | Mitchell et al. | |
| 5,442,832 | A | | 8/1995 | Tonsager | |
| 5,829,905 | A | * | 11/1998 | Woodruff | 401/219 |
| 6,295,689 | B1 | | 10/2001 | Sciacca | |
| 6,808,794 | B1 | | 10/2004 | Mattox | |
| 7,291,228 | B2 | * | 11/2007 | Gathright | 118/504 |
| 2005/0035221 | A1 | | 2/2005 | Gathright | |

* cited by examiner

*Primary Examiner* — Dah-Wei D Yuan
*Assistant Examiner* — Stephen Kitt
(74) *Attorney, Agent, or Firm* — Carter, DeLuca, Farrell & Schmidt, LLP

(57) ABSTRACT

A spray edger device, which is suitable for use with a material application apparatus, said spray edger device includes a planar blade member, a substantially V-shaped frame member for supporting the planar blade member, and a collar member configured for moveably connecting the planar blade member to a barrel portion of a material application apparatus.

15 Claims, 5 Drawing Sheets

SPRAY EDGER DEVICES SUITABLE FOR USE WITH MATERIAL APPLICATION APPARATUS

CROSS-REFERENCE TO RELATED APPLICATIONS

This application claims priority to, and the benefit of, International Application No. PCT/US2009/043497 filed on May 11, 2009, which claims priority to, and the benefit of, U.S. Provisional Application Ser. No. 61/051,995 filed on May 9, 2008, the disclosures of which are herein incorporated by reference in their entireties.

BACKGROUND

1. Technical Field

The present disclosure relates to material application apparatus and, more particularly, to spray edger devices suitable for use with material application apparatus.

2. Discussion of Related Art

Spray painting (sometimes also referred to as surface coating) is a painting technique where a device sprays a product, such as paint, stain or sealer, through the air onto a surface. There are different types of spray guns that are used for spray painting. These are also referred to as paint sprayers and spray applicators. For example, air spray guns of a hand-held type are used to atomize a liquefied stream of paint under the action of pressurized air and spray the resultant paint mist onto a surface. Other types of paint sprayers include: airless, or hydraulic; air-assisted airless; hot airless; high-volume low pressure (HVLP); high-volume, stepped-down low pressure; low-pressure, low volume; thin film atomization; and electrostatic.

Although a higher air pressure provides an increased energy for spraying and a finer atomization of the paint, which may contribute to improved quality of the finished coating, a fine atomized spray increases the risk of spray drift. In some air spray guns, a lower air pressure is used to prevent the spray from scattering. Overspray onto non-target areas may result in increased costs and delay due to rework and repair. There is a need for spray painting devices to prevent or reduce overspray from spray guns.

SUMMARY

The present disclosure relates to a spray edger device, which is suitable for use with a material application apparatus, said spray edger device including a planar blade member, a substantially V-shaped frame member for supporting the planar blade member, and a collar member configured for moveably connecting the planar blade member to a barrel portion of a material application apparatus.

The present disclosure also relates to a spray edger device that is suitable for use with a material application apparatus, said spray edger device including a blade member, a frame member for supporting the blade member, and a spring separable connector configured for moveably connecting the blade member to a barrel portion of a material application apparatus.

BRIEF DESCRIPTION OF THE DRAWINGS

Objects and features of the presently disclosed spray edger devices will become apparent to those of ordinary skill in the art when descriptions of various embodiments thereof are read with reference to the accompanying drawings, of which.

DETAILED DESCRIPTION

Figure 1:
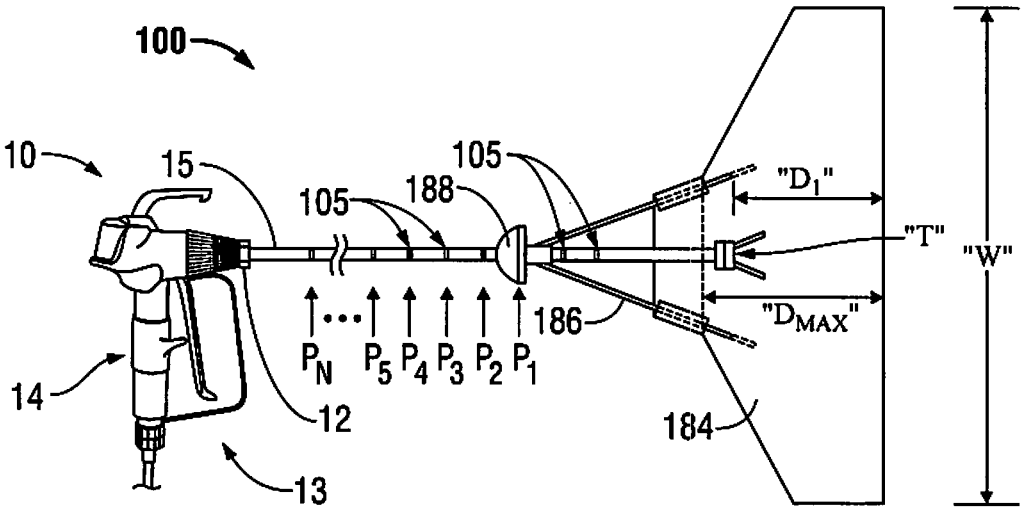
FIG. 1 is a perspective view of a spray edger device that includes an blade member coupled to a spray gun according to an embodiment of the present disclosure.

Hereinafter, embodiments of the presently disclosed paint spray edger will be described with reference to the accompanying drawings. Like reference numerals may refer to similar or identical elements throughout the description of the figures. As shown in the drawings and as used in this description, and as is traditional when referring to relative positioning on an object, the term "proximal" refers to that portion of the apparatus that is closer to the user and the term "distal" refers to that portion of the apparatus that is further from the user. As used in this description, "spray" and "spray pattern" are intended to be understood in their broadest meaning to include not only those processes commonly referred to as "spray" and "spray pattern" but additionally any application technique involving the directing of a coating material across a space towards a target surface. As it is used in this description, "fluid" generally refers to a liquid, a gas or both.

FIG. 1 shows a spray edger device 100, according to an embodiment of the present disclosure, which includes a blade member 184 and a collar member 188. In FIG. 1, the spray edger device 100 is coupled to a material application apparatus shown generally as 10. Material application apparatus 10 may be any suitable spray gun. Material application apparatus 10 (also referred to herein as spray gun 10) includes a handle portion 13 and a material delivery member 14, and may include a barrel portion 15. A connector 12 may be provided for detachably fixing the barrel portion 15 to the material delivery member 14.

The distal end of the barrel portion 15 may be provided with a spray nozzle 17 capable of delivering a volume of a material, such as a coating material, e.g., paint, stain or sealer. Spray nozzle 17 may be capable of delivering a liquid coating material at 2 gallons per minute (gpm) at 3 psi pressure, with the spray pattern covering a width 'W' at a distance "$D_1$" from the nozzle tip "T". It is to be understood that any suitable spray nozzle may be used with any suitable material to be sprayed. The shape and size of the barrel portion 15, the spray nozzle 17, the material delivery member 14, and the handle portion 13 may be varied from the configuration depicted in FIG. 1.

In embodiments, the spray edger device 100 includes a planar blade member 184, a substantially V-shaped frame member 186 for supporting the blade member 184, and a collar member 188 for connecting the blade member 184 to the barrel portion 15 of a spray gun 10. As shown in FIG. 1, the forward lateral edge of the blade member 184 has a width "W". During a spray process, the spray edger device 100 may be oriented with the forward lateral edge of the blade member 184 in contact with the target surface. In embodiments, the blade member 184 is configured and dimensioned to substantially prevent or inhibit overspray when the distance "$D_1$" from the nozzle tip "T" to the forward lateral edge is less than "$D_{MAX}$". Blade member 184 may include any suitable material, including but not limited to, a plastic, such as a thin-gauge plastic, a metal, such as aluminum or steel, a polymer, such as acrylonitrile-butadiene-styrene (ABS) or polyester, or any combination thereof. Blade member 184 may include a transparent material.

In embodiments, the barrel portion 15 may be provided with a plurality of engagement grooves 105 spaced apart with an equal interval disposed on an outer circumferential surface of the barrel portion 15. Collar member 188 may be adapted to selectively allow movement of the blade member 184 along a longitudinal axis of the barrel portion 15. Collar member 188 may be adapted to be releaseably engageable with the engagement grooves 105. The size, number and spacing of the engagement grooves 105 may be varied from the configuration depicted in FIG. 1. The spacing between the respective engagement grooves 105 may be based on various factors, such as a characteristic of the material to be applied (e.g., viscosity), the type of material application apparatus and/or the delivery pressure to be used.

The substantially V-shaped frame member 186 is coupled to the collar member 188. Although the frame member 186 of the spray edger device 100 shown in FIG. 1 has a V-like shape, it will be appreciated that various shapes may be utilized, including but not limited to, a U-like shape. The frame member 186 may include any suitable material, such as metal and/or plastic.

In embodiments, the spray edger device 100 is adapted to allow a worker to adjust the spacing between the spray nozzle 17 and the forward lateral edge of the blade member 184. For example, the collar member 188 may be adapted to selectively allow adjustment of the blade member 184 to any appropriate position (e.g., "$P_1$", "$P_2$", "$P_3$" . . . "$P_N$" shown in FIG. 1) along the barrel portion 15 of a spray gun 10.

Figure 2:
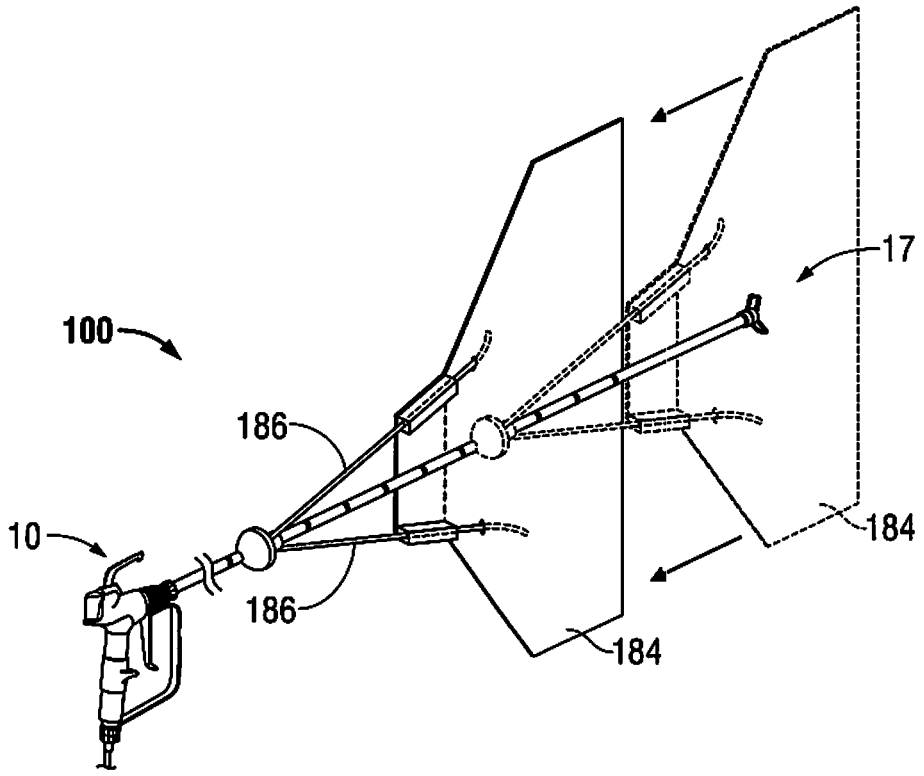
FIG. 2 is a perspective view of the spray edger device of FIG. 1, schematically illustrating various positional configurations (in phantom lines) taken by the blade member in operations, according to an embodiment of the present disclosure.
Figure 3:
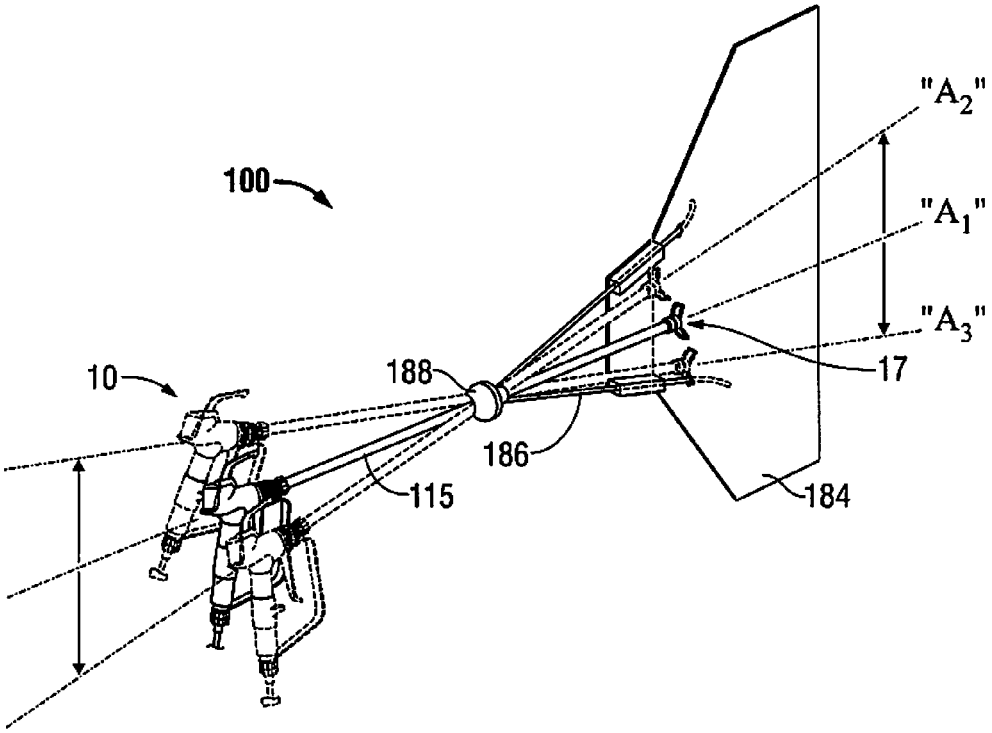
FIG. 3 is a perspective view of the spray edger device of FIG. 1, schematically illustrating various positional configurations (in phantom lines) taken by the spray gun in operations, according to an embodiment of the present disclosure.
Figure 4:
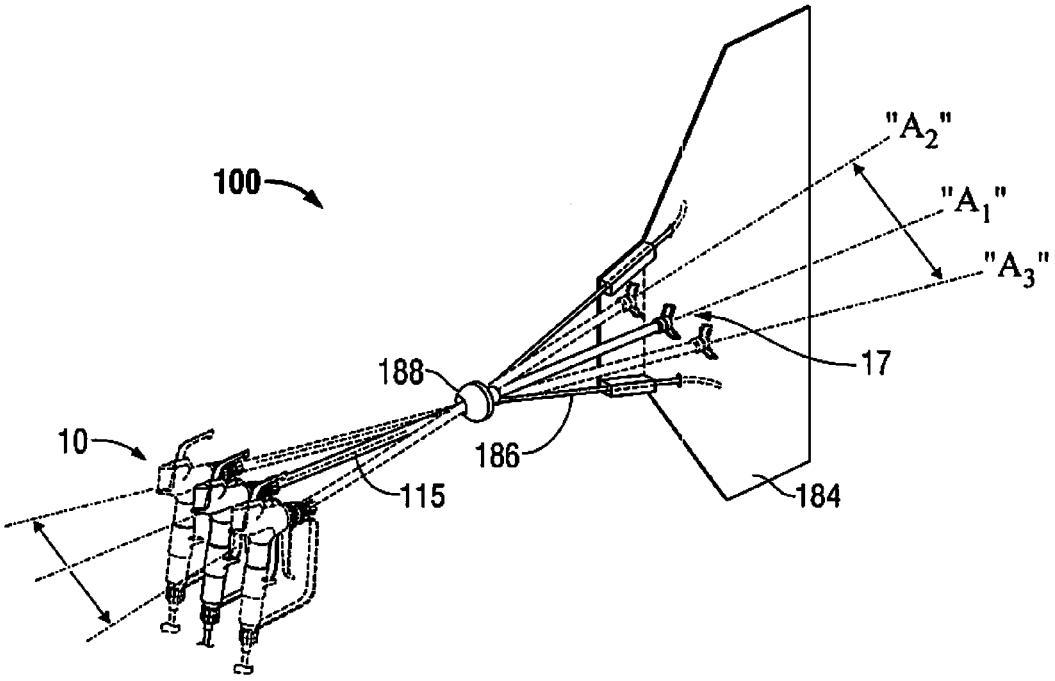
FIG. 4 is a perspective view of the spray edger device of FIG. 1, schematically illustrating various positional configurations (in phantom lines) taken by the spray gun in operations, according to another embodiment of the present disclosure.

In embodiments, the position of the blade member 184 relative to the nozzle tip "T" is adjustable. Collar member 158 may be adapted to selectively allow movement of the blade member 184 to any appropriate position relative to the nozzle tip "T". FIG. 2 depicts some examples of positional configurations that may be taken by the blade member 184. Collar member 158 may be adapted to allow movement of the spray gun 10 such that the nozzle 17 is directed along various longitudinal axes (e.g., "$A_1$", "$A_2$", "$A_3$" shown in FIGS. 3 and 4), e.g., relative to the blade member 184 or target surface. FIGS. 3 and 4 show some examples of positional configurations of the nozzle 17 during operations.

Figure 5:
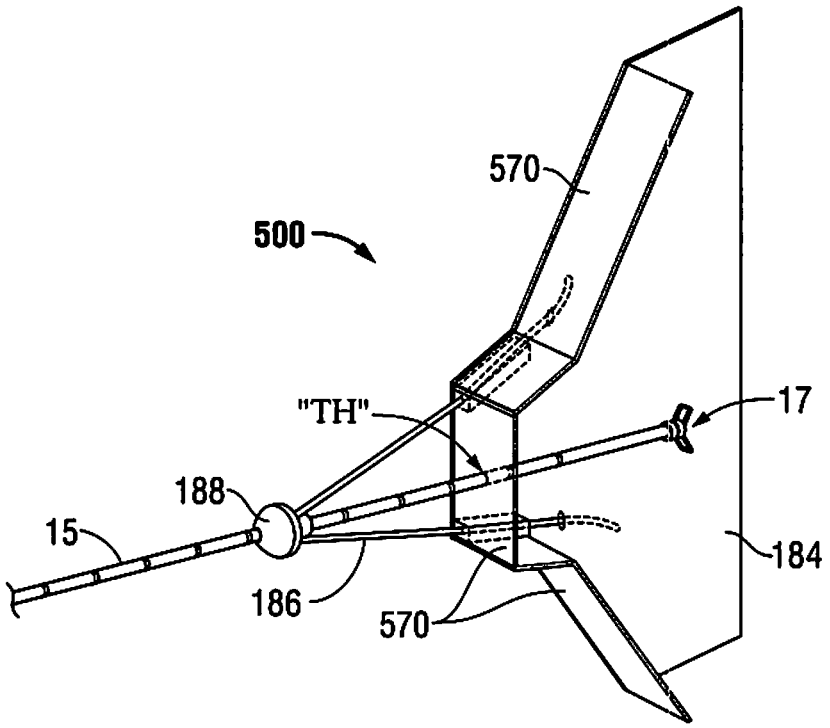
FIG. 5 is a perspective view of a spray edger device that includes an blade member coupled to a barrel member according to an embodiment of the present disclosure.

FIG. 5 shows a spray edger device 500, according to an embodiment of the present disclosure, including a blade member 184 coupled to a collar member 188, which is similar to the spray edger device 100 of FIGS. 1 through 4, except for the flange 570. Flange 570 is provided with a throughhole "TH", which is configured and dimensioned to receive the barrel portion 15 of a spray gun 10. In embodiments, the flange 570 is integrally formed with the blade member 184. In embodiments, the flange 570 and the blade member 184 may be coupled by any suitable manner of bonding, including without limitation, welding, soldering, crimping, or threaded fastening. The size and shape of the flange 570 may be varied from the configuration depicted in FIG. 5.

Figure 6:
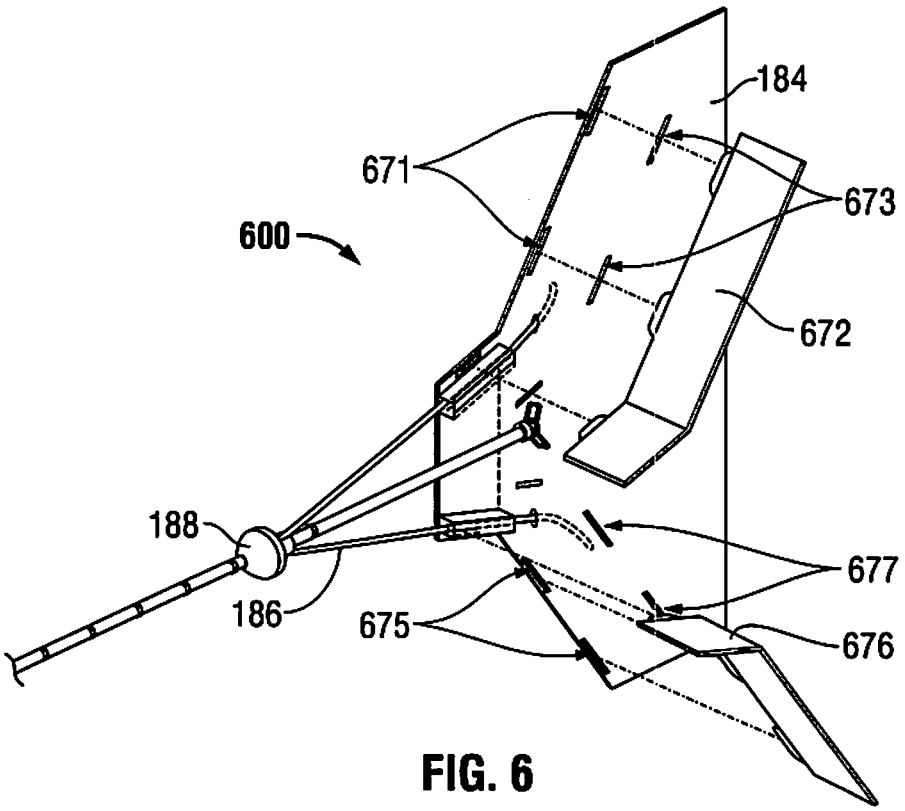
FIG. 6 is a perspective view of another embodiment of an blade member coupled to a barrel member according to the present disclosure.

FIG. 6 shows a spray edger device 600, according to an embodiment of the present disclosure, including a blade member 184 coupled to a collar member 188, which is similar to the spray edger device 100 of FIGS. 1 through 4, except for the two wall inserts 672 and 676, and the elongated slots 671, 675, 673 and 677 formed in the blade member 184. Wall inserts 672 and 676 may be inserted into the slots 671 and 675 to form two walls at the proximal edge of the blade member 184. Wall inserts 672 and 676 may be inserted into the slots 673 and 677 to form two walls within the body of the blade member 184. The size and shape of the wall inserts 672 and 676 may be varied from the configuration depicted in FIG. 6. The size, shape, number and/or arrangement of the slots in the blade member 184 may be varied from the configuration depicted in FIG. 6.

Figure 7:
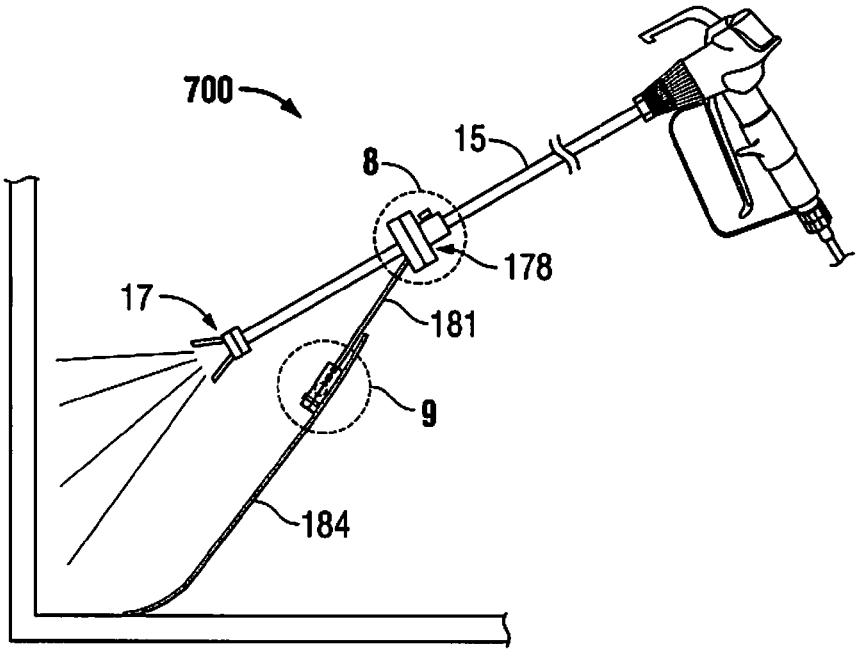
FIG. 7 is a perspective view of a spray edger device that includes an blade member coupled to a collar member according to an embodiment of the present disclosure.
Figure 8:
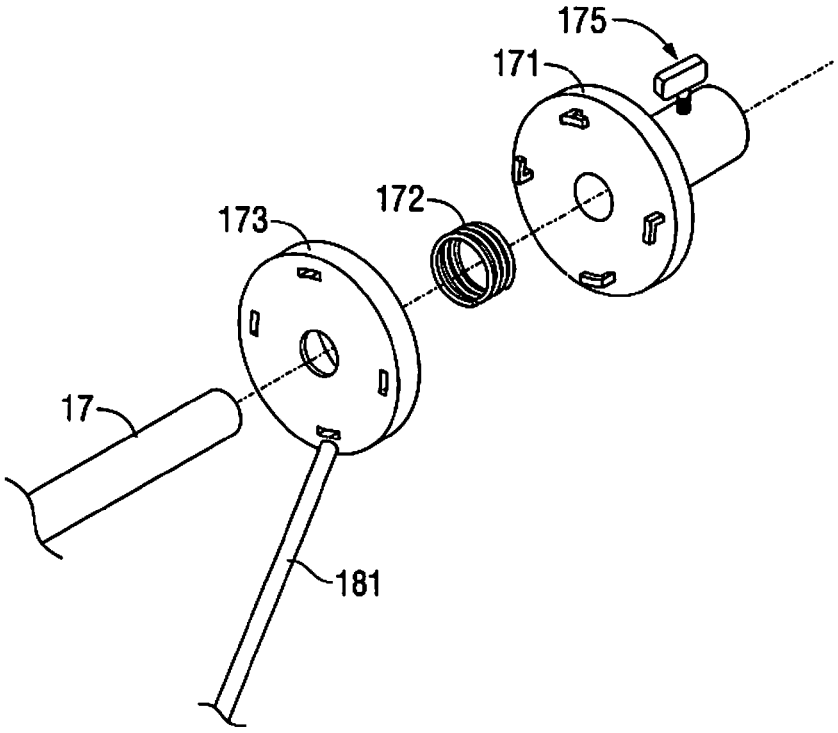
FIG. 8 is an enlarged view of the indicated area of detail of FIG. 7 according to an embodiment of the present disclosure.

FIG. 7 shows a spray edger device 700, according to an embodiment of the present disclosure, which includes a blade member 184 coupled to a collar member 178. In embodiments, the collar member 178 is a spring separable connector. According to an embodiment shown in FIG. 8, the collar member 178 includes a female connector portion 173, a spring 172 and a male connector portion 171, and may include a mechanism 175 to allow selective fixing of a position of the collar member 178 on the barrel portion 15, e.g., a threaded fastener. Application of a rotational force onto the collar member 178 allows the spring-loaded female connector portion 173 to separate from the male connector portion 171, whereby the worker may re-position the collar member 178 on the barrel portion 15 without the need to grasp the collar member 178.

Figure 9:
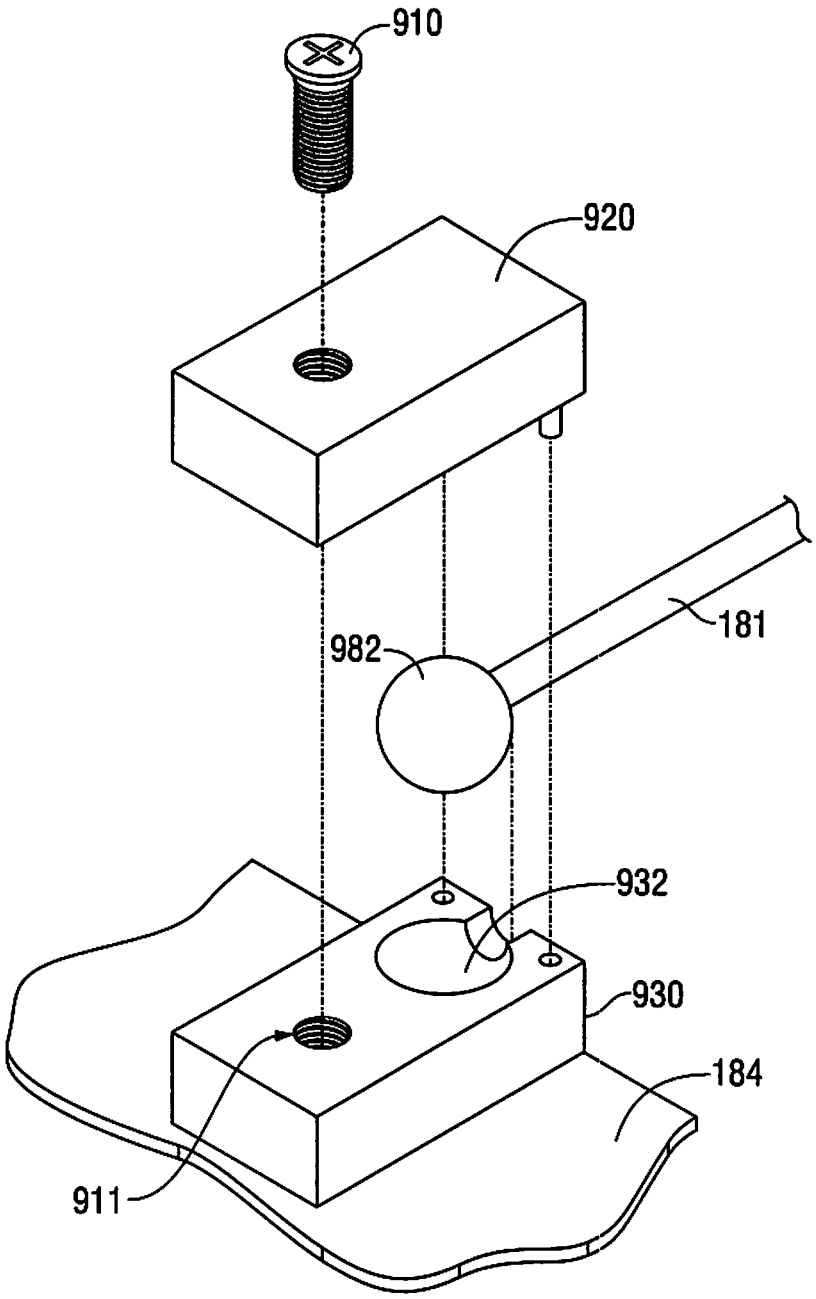
FIG. 9 is an enlarged view of the indicated area of detail of FIG. 7 according to an embodiment of the present disclosure.

According to an embodiment shown in FIG. 9, the blade member 184 is moveably coupled to the support member 181 using a ball 982 and socket 932 mechanism, in which an upper plate 920 is fastened using a threaded fastener 910 to a lower plate 930 having a threaded hole 911.

Although embodiments of the present invention have been described in detail with reference to the accompanying drawings for the purpose of illustration and description, it is to be understood that the inventive processes and apparatus are not to be construed as limited thereby. It will be apparent to those of ordinary skill in the art that various modifications to the foregoing embodiments can be made without departing from the scope of the disclosure.

What is claimed is:

1. A spray edger system, comprising:

a material application apparatus having a cylindrical barrel portion extending therefrom, the barrel portion defining an outer peripheral surface and a longitudinal axis, the barrel portion having a plurality of engagement grooves defined therein and longitudinally-spaced therealong such that a section of the outer peripheral surface extends longitudinally between each pair of adjacent engagement grooves, each engagement groove extending circumferentially about the barrel portion and oriented perpendicularly relative to the longitudinal axis of the barrel portion; and a spray edger releasably engaged with the material application apparatus, the spray edger including:

a planar blade member extending in parallel orientation relative to the longitudinal axis of the barrel portion of the material application apparatus;

a frame member having first and second frame portions, first ends of the first and second frame portions being spaced-apart a greater distance than second ends of the first and second frame portions so as to define a substantially V-shaped configuration of the frame member, the first and second frame portions supporting the planar blade member thereon at the first ends thereof, wherein the first and second frame portions are fully disposed within a plane that extends in parallel orientation relative to the planar blade member, and wherein the first and second frame portions extend from the longitudinal axis of the barrel portion of the material application apparatus at equal, opposite acute angles; and a collar member coupled to the second ends of the first and second frame portions, the collar member slidably positionable about the barrel portion of the material application apparatus and configured for releasable engagement within each of the engagement grooves of the barrel portion to retain the collar member in a corresponding one of a plurality of discrete longitudinally-spaced positions along the barrel portion, wherein the collar member is longitudinally slidable about the barrel portion in fixed rotational orientation relative to the barrel portion from one of the engagement grooves, along a section of the outer peripheral surface of the barrel portion, to an adjacent one of the engagement grooves.

2. The spray edger system of claim 1, wherein at least a portion of the planar blade member is transparent.

3. The spray edger system of claim 1, wherein the collar member is adapted to selectively allow movement of the planar blade member relative to a nozzle of the material application apparatus.

4. The spray edger system of claim 3, wherein the planar blade member is configured and dimensioned to inhibit overspray when a distance from the nozzle to a forward lateral edge of the planar blade member is less than a predetermined maximum distance.

5. The spray edger system of claim 1, wherein the spray edger further includes a flange provided with a throughhole that is configured and dimensioned to receive the barrel portion of the material application apparatus.

6. The spray edger system of claim 5, wherein the flange is integrally formed with the planar blade member.

7. The spray edger system of claim 5, wherein the flange is fixedly attached to the planar blade member by at least one of welding, soldering, crimping, and threaded fastening.

8. The spray edger system of claim 1, wherein the spray edger further includes a plurality of wall inserts.

9. The spray edger system of claim 8, wherein the spray edger further includes a plurality of elongated slots, each of said elongated slots configured and dimensioned to an end portion of the wall inserts.

10. The spray edger system of claim 1, wherein the first and second frame portions and the barrel portion are disposed in a common plane.

11. The spray edger system of claim 10, wherein the barrel portion is tiltable relative to the first and second frame portions within the common plane.

12. The spray edger system of claim 10, wherein the barrel portion is tiltable relative to the first and second frame portions out of the common plane.

13. The spray edger system of claim 10 wherein the common plane is disposed in parallel orientation relative to the planar blade member.

14. The spray edger system of claim 1, wherein the plurality of longitudinally-spaced engagement grooves are equally-spaced.

15. The spray edger system of claim 1, wherein the spray edger is symmetrical about opposing sides of the barrel portion.

* * * * *